United States Patent [19]

Waterbury

[11] 4,170,724

[45] Oct. 9, 1979

[54] VENDABLE RECLOSABLE BEVERAGE CONTAINER

[76] Inventor: Nelson J. Waterbury, Marschall Str. 9, 8 Munich 40, Fed. Rep. of Germany

[21] Appl. No.: 889,836

[22] Filed: Mar. 24, 1978

Related U.S. Application Data

[63] Continuation of Ser. No. 763,717, Jan. 28, 1977, abandoned.

[51] Int. Cl.[2] ..... B65D 43/20; B65D 51/18

[52] U.S. Cl. ..... 200/346; 220/345; 220/254

[58] Field of Search ..... 220/346, 345, 90.2, 220/90.4, 214, 254, 269; 222/541, 544, 585

[56] References Cited

U.S. PATENT DOCUMENTS

| | | | |
|---|---|---|---|
| 2,199,787 | 5/1940 | Dillard | 220/254 X |
| 3,332,586 | 7/1967 | Amburgey | 220/345 X |
| 3,363,798 | 1/1968 | Garangiotis | 220/345 X |
| 3,705,670 | 12/1972 | Douty | 220/345 X |

*Primary Examiner*—Steven M. Pollard

*Attorney, Agent, or Firm*—Brumbaugh, Graves, Donohue & Raymond

[57] ABSTRACT

A container having a slide closure accommodated in a guideway recessed beneath the upper surface of the lid in which the guideway is defined between a pair of parallel walls depending from the upper surface of the lid connected by a recessed portion of the lid and in which the slidable closure moves within the guideway from a position closing an opening in the recessed portion of the lid to an open position.

3 Claims, 5 Drawing Figures

FIG. 1
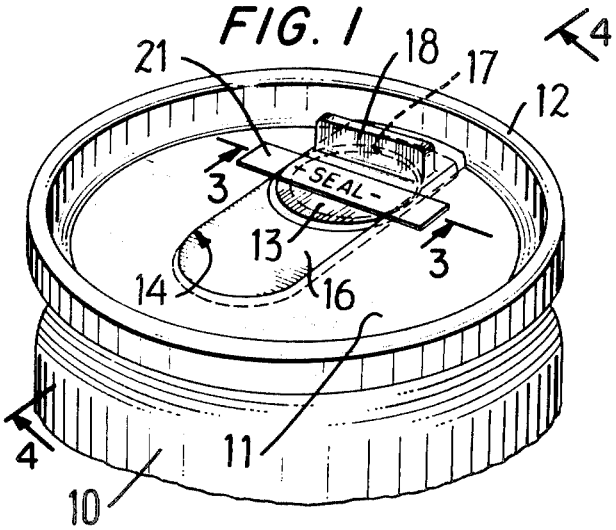
FIG. 2
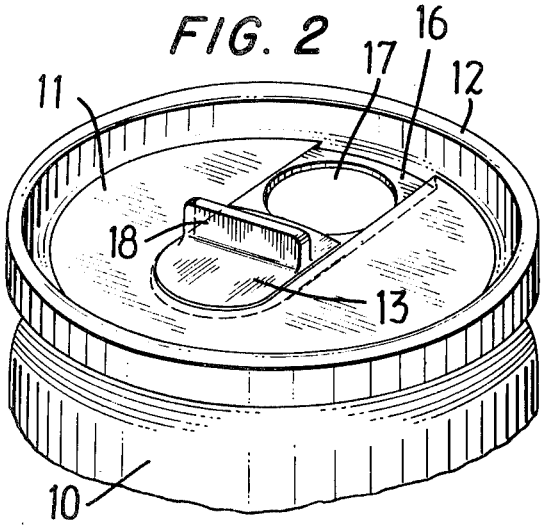
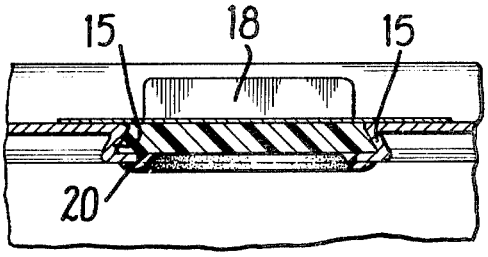
FIG. 3
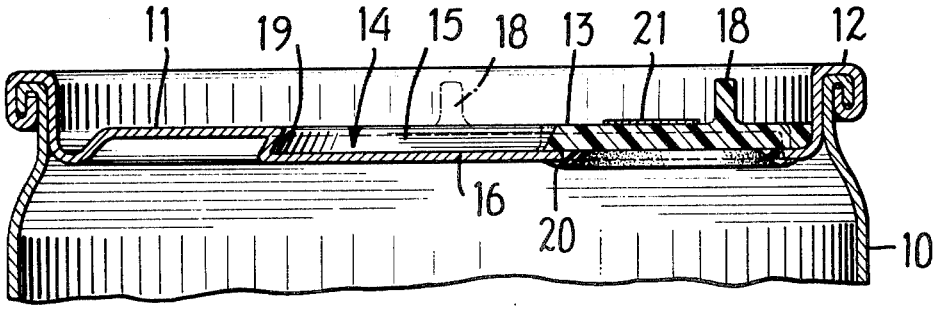
FIG. 4
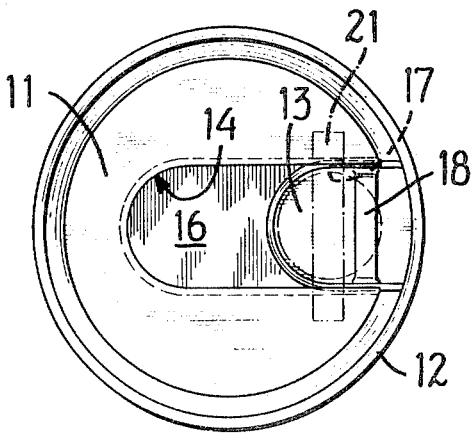
FIG. 5

VENDABLE RECLOSABLE BEVERAGE CONTAINER

This is a continuation, of application Ser. No. 763,717, filed Jan. 28, 1977, now abandoned.

This invention relates to improvements in sealed containers, for example of the type used to vend beverages and foods, and more particularly to a container having a novel closure which can be easily and safely opened and reclosed without separating any parts from the container and without generating any throw-away debris.

The most common of the conventional easy-to-open containers is the type having a flip-top tab closure in which the tab is removed with the help of a lift ring. These containers have fallen into disrepute primarily because they generate litter and their sharp edges are a hazard to safety. Other disadvantages include a difficult to lift ring that can damage the fingernails and the danger that the removable tab will be dropped into the container and accidentally swallowed.

More recently containers having push-in hinged closures have been introduced, and although they overcome some of the environmental and safety problems of the flip-top tab closures, they have other disadvantages, namely, contamination of the contents of the container by the closure pushed therein and the danger that the hinge will break and the closure will drop into the contents of the container. Neither of these currently available containers can be reclosed in the event that it is desirable to store the unused contents of the container.

The container of the present invention overcomes these disadvantages and provides a vendable, hermetically sealed container which can be stacked, easily opened without injury to the user and then resealed to store the unused contents without separating any parts from the container and without generating any debris.

The container of the present invention embodies a slide closure accommodated within a guideway in which the guideway is formed in the lid beneath the upper surface thereof and defined between a pair of parallel depending walls connected at their lower ends by a recessed portion of the lid. An opening is formed in the recessed portion of the lid at one end of the guideway for the discharge of the contents of the container, and the slide closure can be readily actuated for movement within the guideway from a position closing the opening to an open position and back to a reclosed position to store the contents of the container.

For a complete understanding of the present invention reference can be made to the detailed description which follows and to the accompanying drawings in which:

FIG. 1 is a perspective view of the upper portion of a container embodying the slide closure of the present invention showing the closure in closed position;

FIG. 2 is a perspective view similar to FIG. 1 showing the slide closure in open position;

FIGS. 3 and 4 are views taken along the lines 3—3 and 4—4, respectively, of FIG. 1, looking in the direction of the arrows; and FIG. 5 is a plan view of the container embodying the present invention.

The container of the present invention includes a cylindrical sidewall 10, an upper lid 11 joined to the upper end of the sidewall by an upstanding chime 12 and a bottom (not shown), preferably of the same shape and diameter as the upper end to permit the containers to be stacked.

The lid has a slide closure 13 recessed therein within a guideway generally designated by the reference numeral 14. The guideway 14 is defined by a pair of parallel walls 15 depending from the upper surface of the lid and connected at their lower ends by a recessed portion 16 of the lid. An opening 17 is formed in the recessed portion 16 of the lid at one end of the guideway for the discharge of the contents from the container.

The slide closure 13 is accommodated for movement within the guideway from a position closing the opening, as shown in FIG. 1, to an open position at the opposite end of the guideway, as shown in FIG. 2. The slide closure has an upstanding finger gripping means 18 formed thereon to facilitate actuation thereof. The height of the finger gripping actuator is such as to insure that it is recessed beneath the upper end of the chime 12 so that it will not interfere with the stacking of the containers.

The depending walls 15 of the lid which define the guideway, as best shown in FIG. 3, extend downwardly and outwardly from the inner edge of the upper surface of the lid to the outer edge of the recessed portion 16 of the lid. The side edges of the slide accommodated therein are preferably shaped in complementary fashion to interlock with the diagonally sloped walls 15 of the guideway.

The guideway extends part way across the upper surface of the lid, and as shown in FIG. 4, the end of the guideway is defined by a depending wall 19 which forms a stop for the slide closure in open position. The end of the guideway and the corresponding end of the slide closure are of generally complementary semi-circular shape. The upstanding chime 12 forms a stop for the slide closure in its opposite extreme closed position.

A seal 20 bridging the undersurfaces of the lid and the slide closure across the opening 17 hermetically seals the container. This seal can be provided in the form of a thin film or layer of non-toxic resinous material of the type sometimes used to seal conventional flip-top tab closures. The inner thin seal, sprayed or otherwise applied to the bottom of the lid and slide closure, adheres to the lid and closure and forms an effective seal which can be easily broken when the slide closure is displaced from closed to open position. To insure the integrity of the container when subjected to internal pressures in the order of 95 pounds per square inch, or when subjected to atmospheric pressure with the contents of the container under vacuum, the seal 20 is formed of suitable plastic materials with appropriate resilience to perform its function.

The container is preferably formed of metal or other suitable rigid material with the guideway 14 preferably formed or machined integrally with the lid. The slide closure can be formed of plastic or metal material. The inherent resiliency of the materials of the container and the slide closure should permit the slide closure to be force-fitted into interlocking relationship within the guideway. The thickness of the slide closure is preferably about the depth of the guideway so that when it is interlocked therein the upper surface of the slide closure is substantially coplanar with the upper surface of the lid.

To further insure the integrity of the container, a frangible seal or stamp 21 can be applied transversely across the upper coplanar surfaces of the lid and slidable closure after the container has been filled and sealed.

The displacement of the slidable closure from the original closed and sealed position will break the seal or stamp and warn the purchaser that the seal 20 has been broken.

The container of the present invention can be readily opened by displacing the slide closure from closed position to open position, breaking the inner seal 20 to permit the slide closure to move to open position without the help of any tools or utensils or without generating any litter. Part of the seal will adhere to the bottom of the slide closure as it is displaced within the guideway so that when the slide closure is restored to closed position an effective tight reseal will be achieved to store the unused contents of the container.

The invention has been shown and described in preferred form and by way of example only, and different variations and modifications can be made therein within the spirit of the invention. The invention, therefore, is not intended to be limited to any particular form or embodiment except in so far as such limitations are expressly set forth in the claims.

I claim:

1. A sealed beverage container comprising an upstanding chime around the outer periphery of the upper end of the container, a lid of substantially uniform thickness recessed beneath the upper edge of the chime, an open guideway recessed beneath the upper surface of the lid and extending from the chime at least part way across the upper surface of the lid, a pair of opposite walls depending from the lid along bend lines and defining part of said guideway, a recessed portion of the lid connected by bend lines from the lower ends of the depending walls and defining both part of the lid and the bottom surface of said recessed guideway, the depending walls of the guideway extending from the inner edge of the upper surface of the lid downwardly and outwardly to the outer edge of the recessed portion of the lid, the lid, depending walls and recessed portion of the lid formed as integral parts of the lid of material of substantially uniform thickness, a pour opening in the recessed portion of the lid at the end of the guideway near the chime for the discharge of the contents of the container, a slide closure having a pair of edges interlocked and slidable within the guideway from a position closing the pour opening to an open position, finger engaging means formed on the slide closure to facilitate movement thereof within the guideway, the thickness of the slide closure within the guideway and the depth of the guideway being substantially equal and including an upper surface of the slide closure which is substantially coplanar with the upper surface of the lid, the upstanding chime defining a concavely curved stop for the slide closure in sealed position with the leading end of the slide closure and the stop surface defined by surfaces of complementary shape across the entire width of the guideway to insure flush engagement of the slide closure with the chime in sealed position, and a frangible seal adhering to and bridging the undersides of the recessed portion of the lid and the undersides of the slidable closure to hermetically seal the opening when the closure is in closed position and to permit breakage of the frangible seal when the slide closure is moved to open position.

2. A container as set forth in claim 1 in which the finger engaging means includes upstanding finger gripping means formed on the slide closure to facilitate actuation thereof within the guideway, the height of said finger gripping means being such as to recess the upper end thereof beneath the upper end of the container.

3. A container as set forth in claim 1 including a seal extending transversely of the guideway adhering to the upper coplanar surfaces of the lid and slidable closure.

* * * * *